US005660036A

United States Patent [19]

Rozenwasser

[11] Patent Number: 5,660,036

[45] Date of Patent: Aug. 26, 1997

[54] JEWELRY ROPE CHAIN

[76] Inventor: David Rozenwasser, 26 Har Dafna Street, Savion, Israel

[21] Appl. No.: 354,318

[22] Filed: Dec. 12, 1994

[51] Int. Cl.[6] ..... B21L 5/02

[52] U.S. Cl. ..... 59/80; 59/3; 59/83

[58] Field of Search ..... 59/80, 78, 83, 59/35.1, 1, 3

[56] References Cited

U.S. PATENT DOCUMENTS

| | | | |
|---|---|---|---|
| D. 321,148 | 10/1991 | Chiaramonti et al. . | |
| D. 329,828 | 9/1992 | Bedoyan | D11/13 |
| D. 330,175 | 10/1992 | Kahan | D11/13 |
| D. 330,343 | 10/1992 | Bedoyan | D11/13 |
| D. 340,422 | 10/1993 | Grando . | |
| D. 343,136 | 1/1994 | Grando . | |
| D. 343,806 | 2/1994 | Bedoyan | D11/13 |
| 4,651,517 | 3/1987 | Benhamou et al. . | |
| 4,934,135 | 6/1990 | Rozenwasser . | |
| 4,996,835 | 3/1991 | Rozenwasser . | |
| 5,125,225 | 6/1992 | Strobel . | |
| 5,129,220 | 7/1992 | Strobel . | |
| 5,185,995 | 2/1993 | Dal Monte . | |
| 5,285,625 | 2/1994 | Ofrat et al. . | |
| 5,303,540 | 4/1994 | Rozenwasser . | |
| 5,361,575 | 11/1994 | Rozenwasser . | |
| 5,412,935 | 5/1995 | Rozenwasser | 59/80 |
| 5,452,572 | 9/1995 | Alvaro et al. | 59/80 |

OTHER PUBLICATIONS

"Sharrah Designs, Inc." Unique in Design Unparalleled in Concept, Oct. 1989, p. 171.

*Primary Examiner*—David Jones
*Attorney, Agent, or Firm*—Seligsohn & Gabrieli

[57] ABSTRACT

A jewelry rope chain formed of a number of links of wire of a cross sectional configuration. The links are intertwined to form an outer appearance of a double helix. A predetermined number of the links is required to form a full helix cycle. At least some of the overall geometric shapes of the links within a full helix cycle are different from the overall geometric shapes of the other links within the same helix cycle. The chain can be formed either by initially selecting the links of different geometric shapes and intertwining them in accordance with a desired sequence. Alternately, initially the chain can be formed of uniform links and thereafter the entire chain rolled or reshaped so as to reconfigure the shape of at least some of the links with respect to other of the links within a full helix cycle.

22 Claims, 6 Drawing Sheets

JEWELRY ROPE CHAIN

FIELD OF THE INVENTION

This invention relates to a jewelry chain and more specifically to a particular type of jewelry chain popularly known as a rope chain, as well as a method of making such rope chain.

BACKGROUND OF THE INVENTION

Jewelry rope chains are formed from individual links made of wire with the various links being tightly interfit one into the other so as to be intertwined and fit one against the other to form an outward appearance of a double helix. The links generally have a small gap formed within their periphery to enable one of the other links to pass through the gap. A number of links are interconnected in accordance with particular ratios and thereafter a group is formed together. A new group is then begun interconnected to the old group and again the group is repeated.

The particular formation of the rope chain has become quite sophisticated and numerous improvements have been made in order to reduce the amount of gold required in the formation of the rope chain and yet obtain an acceptable outer appearance. Historically, the links were typically of circular configuration having an inner and outer diameter with a gap formed in the circumference. The links typically form the shape of an annulus such as a tire.

Typically, the ratio of the inner diameter of the link annulus to the diameter of the wire forming the link was of a ratio slightly greater than three. In such situations, three of such links were interfit one into the other and then a fourth link intertwined the other three.

U.S. Pat. No. 4,651,517 to Benhamou, et al. described a method of reducing the amount of gold by increasing the ratio from the 3:1 ratio to an odd ratio of 5:1 and greater. In such cases, the ratio of the inner diameter of the link annulus to the wire diameter forming the link was thus slightly greater than 5:1. Thus, five individual links would be intertwined and a sixth would be intertwined with the original five, thereby forming a group.

Although typically an odd number of links were utilized for each group with one additional one intertwining them, U.S. Pat. No. 4,934,135 to Rozenwasser describes the use of an even number of links with an even ratio.

While generally circular shaped links have been used, U.S. Pat. No. 4,996,835 to Rozenwasser showed that elliptical shaped links and other geometric configurations could also be utilized. Additionally, chains using other link configuration have been known such as those shown in Design Patents 340,422 and 343,136 issued to Grando, and Design Patent 321,148 issued to Chiaramonti, et al. Many other types of geometric shaped links have also been suggested.

The particular shape of the wire utilized to form the link has also varied over the years. While historically circular cross sectional wire had been used, numerous other configurations have been shown such as those in U.S. Pat. No. 5,185,995 to Dal Monte as well as the rectangular cross sectional configuration shown in U.S. Pat. No. 5,361,575 to Rozenwasser, and others.

The particular wire utilized to form the link can either be solid wire or hollow wire. In the case of hollow wire, the wire can either be with an open channel or seam along the inner periphery of the link or it can be without the seam or channel. The use of the seam or channel is to permit melting out of the material used to fill the hollow center of the wire during its formation into a hollow wire for use in the formation of the individual links.

In order to improve the appearance of the rope chain, there has been introduced the idea of shaving or cutting a portion of the exterior surface of the rope chain in order to provide what is generally referred as a diamond cut faceted rope chain. When dealing with solid wire in forming the links, the rope chain is then referred to as a solid rope chain. In such cases, it is relatively easy to provide the facets. As the wire is solid, there is no problem in shaving off a portion of the wire to change the external configuration of a round shape to a flat facet. Typically, the solid wire rope chain is passed longitudinally through a series of cutting blades which cut the exterior along a fixed number of sides. Usually, it is cut along four sides to provide a square like configuration with the four sides being cut. However, other shapes, such as hexagonal, can also be formed with a diamond cut configuration.

When dealing with rope chain formed of hollow wire, the rope chain is referred to as a hollow rope chain. In such cases, it had been difficult if not impossible to achieve diamond cut facets on the rope chain. Utilizing the same shaving or cutting technique as is used for solid rope chain would cut into the wire itself. Because the wire is only of a thin wall construction, cutting a portion of that hollow wire tubing would cut through the wall and penetrate it. Since, the depth of cut is greater than the thickness of the wall.

In order to achieve a simulated diamond cut, it had been suggested in U.S. Pat. Nos. 5,125,225 and 5,129,220 issued to Strobel, to deform the exterior surface wall of the hollow rope chain to provide to simulated diamond cuts. These patents describe initially forming a hollow rope chain and then wrapping the rope chain around a mandrel and freezing the chain. Thereafter, a pounding action is provided against the exterior wall of the rope chain along four or six sides, to flatten or deform the exterior wall of the rope chain along these sides. Thus, the hollow exterior wall of the wire is depressed inwardly toward the interior wall of the wire so as to flatten the wire itself.

Another approach to achieving diamond cut facets on a hollow rope chain is described in U.S. Pat. No. 5,285,625 issued to Orfat, et al. While the heretofore described Strobel patents provided simulated diamond cuts along four or six sides, the Orfat patent describes a spiral facet which is formed around the periphery of the rope chain in a spiral configuration. The facets formed in Strobel are only on four sides and provided a substantially square, or hexagonal cross sectional configuration to the chain. The facets formed by Orfat provide a substantially circular cross sectional configuration.

Another approach to providing facets in hollow rope chain is described in U.S. Pat. No. 5,303,540 to Rozenwasser which provides a shallow band or strip extending along the surface of at least a part of the outer perimeter of the link to give a diamond cut appearance to the rope chain.

While these suggested approaches to achieving a diamond cut hollow rope chain have been useful, there is still a need for an efficient method of producing such diamond cut rope chain and which permits the ability of providing the exterior shape of the rope chain as desired.

Furthermore, it would also be desirable to give greater control to the manufacturer to reshape the exterior of a rope chain, not only to produce facets, but to provide any desired shape to the exterior.

SUMMARY OF THE INVENTION

Accordingly, it is an object of the present invention to permit greater flexibility in shaping the exterior of a rope chain to any desired configuration.

A further object of the present invention is to permit the shaping of the exterior configuration of a rope chain to provide diamond cut facets, and especially to permit such diamond cut facets to be provided on a hollow rope chain without deformation of the link wire cross section.

Yet another object of the present invention is to permit the initial formation of the rope chain in such a manner that the desired exterior shape is provided during the course of the initial manufacture of the rope chain and specifically during the intertwining of the various links.

Still a further object of the present invention is to permit the reshaping of an initially formed rope chain to any desired shape by modifying the shape of various links contained within the formed rope chain.

More specifically, the present invention provides for a jewelry rope chain which is formed of a plurality of links. Each of the links is formed of a wire having a respective cross sectional configuration. Each link has a small gap formed in it in order to enable another link to pass through the gap. The links are then intertwined to form an outward appearance of a double helix. A predetermined number of these links are required in order to form a full helix cycle. In accordance with the present invention, at least some of the overall geometric shapes of the links within a full helix cycle are different from the overall geometric shape of other links within the same helix cycle.

In accordance with a preferred embodiment of the invention, the overall geometric shape of the individual links forming a full helix cycle of the chain sequential define repetitive sequences of geometric shapes.

By selecting the particular geometric shapes of the links within the sequence, any desired overall configuration of the chain can be achieved. One of these configurations includes the simulation of facets on the exterior surface of the chain, either on four sides, six sides, or as desired.

In accordance with a first method of forming the chain, initially the links which are utilized to form the chain have different overall geometric configurations. The links are then selected in accordance with a predesired sequence and are put together in that sequence so that within the required number of links forming a full helix cycle of the chains there are utilized links of different overall geometric shapes.

In accordance with a second method of forming the invention, initially the rope chain is formed utilizing links all of which have the same geometric shape. However, after the chain has been formed, the chain is passed through a series of rollers which serve to reshape the geometric shape of at least some of the links within each full helix cycle in order to provide an external configuration, as desired.

It should be appreciated that in the course of the rolling operation, the rollers do not deform the cross sectional configuration of the wire itself. Instead, the rollers deform the overall geometric shape of the link. By way of example, it can change the overall configuration of the link from a circular configuration to an oval configuration.

It should be appreciated that the present invention is applicable to both solid rope chains and hollow rope chains. Furthermore, it can be utilized with any ratio of inner diameter of the link annulus to the diameter of the wire. It can be further utilized with any geometric shape of the link as desired as well as any geometric shape of the cross section of the wire itself.

BRIEF DESCRIPTION OF THE FIGURES

In the figures.

In the various figures of the drawings, like characters identify like parts.

DETAILED DESCRIPTION OF THE INVENTION

Figure 1:
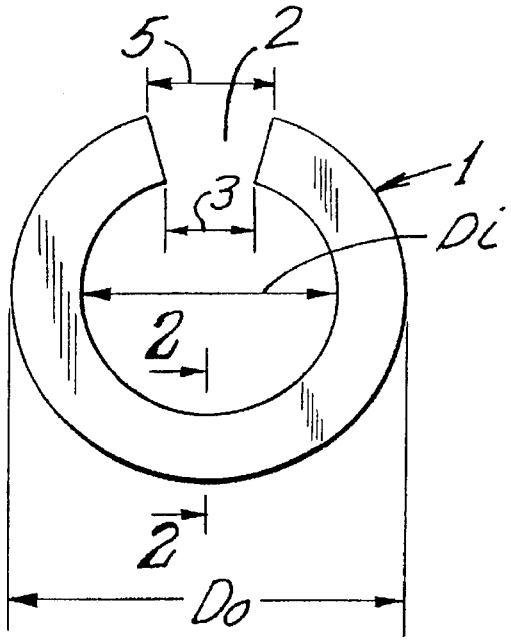
PRIOR ART FIG. 1
FIG. 1 is a schematic view of a link of the prior art for use in the manufacture of a prior art rope chain.

Rope chains are generally formed from individual links, by way of example shown in FIG. 1. In such figure, there is shown a circular ring 1 which has an opening or gap 2 formed therein. The gap 2 has a narrow dimension 3 at its inner diameter and a wider dimension 5 at its outer diameter. The inner diameter of the link is shown along the arrow as Di and the outside diameter of the link is shown by the dimension Do.

Figure 2:
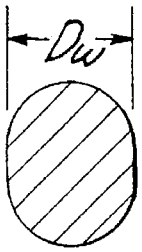
PRIOR ART FIG. 2
FIG. 2 shows a cross sectional configuration of the link shown in FIG. 1 wherein the link is of a solid wire.
Figure 3:
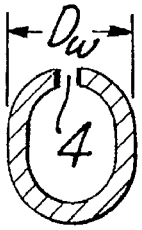
PRIOR ART FIG. 3
FIG. 3 is a cross sectional view similar to that shown in FIG. 2 but showing how the cross sectional configuration would appear utilizing a hollow wire.

The wire can be formed either of solid configuration, as shown in FIG. 2 or of hollow configuration shown in FIG. 3. In the case of the hollow configuration, there is typically provided a seam 4 at the inner periphery of the link in order to permit removal of the soft metal wire core used to form the hollow link. The diameter of the wire is shown as Dw.

Figure 5:
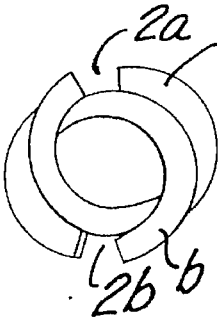
PRIOR ART FIG. 5

The relative orientation of the rings forming the rope chain according to the prior art is shown in FIGS. 4–7. As shown FIG. 4, the ring "a" is initially oriented so that its gap 2*a* lies in a direction facing generally upward. The second ring of this assembly, designated as "b" is passed through the gap 2*a* of the ring "a" with the gap 2*b* of the ring "b" facing downwardly as shown in FIG. 5. The rings "a" and "b" are juxtaposed and intertwined so that they lay against each other with the periphery of the ring "b" lying against the periphery of the ring "a", to the greatest extent possible, thereby creating a relatively large central opening 5.

Figure 6:
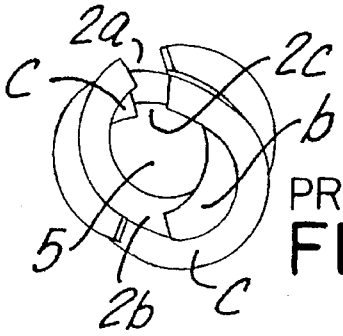
PRIOR ART FIG. 6

The gap 2*c* of a third ring "c" is then passed through the gap 2*b* of the ring "b" and over the minor diameter of the ring "a" and layed angularly against the "a" and "b" rings. The gap 2*c* of the ring "c" lying in the same orientation of the gap 2*a* of the ring "a" as shown in FIG. 6. A central opening 6 still remains within the now three intertwined rings "a", "b" and "c".

Figure 7:
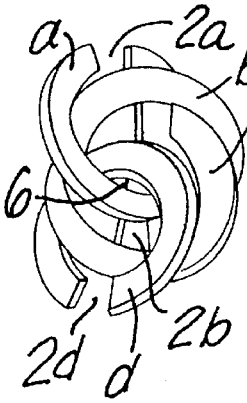
PRIOR ART FIG. 7

As shown in FIG. 7, the gap 2*d* of a fourth ring "d" is now passed over the rings "a", "b" and "c" through the central openings and thereby envelopes the first three rings.

This intertwined orientation of the four rings is then repeated with a new series and continues to create a double helix rope chain of a desired length. In the specific example shown in FIGS. 4–7, a ratio of just over 3 between the inner ring diameter Di and the diameter of the wire, Dw is being utilized. However, as heretofore described in the U.S. Pat. No. 4,651,517, other ratios such as 5:1 and greater can be utilized. Furthermore, chains in accordance with that described in that aforementioned U.S. Pat. No. 4,934,135 to Rozenwasser utilizing even number ratios can also be utilized.

Figure 8:
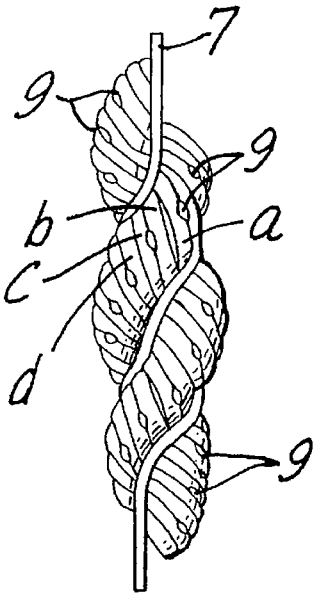
PRIOR ART FIG. 8
FIG. 8 shows assembly of the rope chain with the forming wire not removed.
Figure 4:
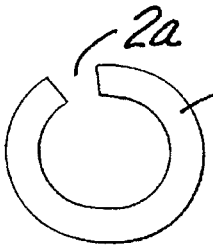
PRIOR ART FIG. 4
FIGS. 4–7 show various steps in the construction of a rope chain by intertwining four links of the prior art.

During the build up of the rings in the manner just described to form the double helix rope chain, the rings are held in the desired juxtaposition temporarily by a thin metal wire 7 wrapped around the rings as shown in FIG. 8. Solder 9 is then intermittently applied to every pair of adjacent rings, usually at two points of the exterior periphery thereof. The wire 7 is then removed whereby there results a rope chain shown in FIG. 9 of the typical double helix configuration.

Figure 9:
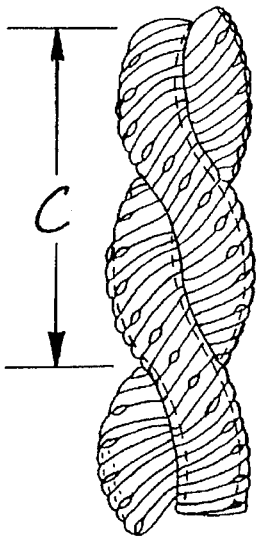
PRIOR ART FIG. 9
FIG. 9 shows the double helix configuration of a prior art rope chain.

It will be appreciated that as shown in FIG. 9, the double helix configuration repeats itself throughout the entire length of the rope chain in unit sections of helix cycles. As shown in FIG. 9, a full helix cycle is shown by the cycle "c" and basically includes 360° of the helix as it moves around a complete circle. It will be noted from FIG. 9, that in order to complete a full helix cycle as heretofore defined, quite a number of individual links are required. The specific number of links required is dependent upon a number of factors, including the outside diameter of the desired chain, the thickness of the wire, the ratio of inner diameter of link annulus Di to the wire diameter Dw, and other factors.

By way of a mathematical example, assume the outside diameter of the overall chain Dc is to be 3 mm. The circumference of the chain will then be $\pi$ or equal to 9.42 mm. Then, assuming an approximate 3:1 ratio, we can determine the thickness of the wire as follows:

$$\frac{Di}{Dw} = 3$$

and $$Do-Di=2Dw$$

since $$Do=Dc=3$$

$$3-Di=2Dw$$

and substituting for Di $$3-3DW=2Dw$$

$$3=5Dw$$

$$Dw=0.6 \text{ mm}$$

In order to determine the number of links in a full helix cycle of 360°, we must divide the circumference of the chain by the thickness of the wire as follows:

$$\frac{\text{circumference}}{\text{thickness}} = \text{No. of links in full helix cycle thickness}$$

-continued $$\frac{9.42}{0.6} = 15.7 \text{ links}$$

By way of another example, if a 5:1 ratio were utilized, then we have as follows:

$$\frac{Di}{Dw} = 5$$

and $$Do-Di=2Dw$$

since $$Do=Dc=3$$

$$3-Di=2Dw$$

and substituting for Di $$3-5Dw=2Dw$$

$$3=7 \text{ Dw}$$

$$Dw=0.43$$

and No. of links in full helix cycle is $$\frac{9.42}{0.43} = 21.9 \text{ links}$$

It should thus be appreciated, that this number of links are need in order to complete one full helix cycle of the chain. This number can vary based upon the ratio of Di:Dw, the thickness of the rope Dc chain and numerous other factors.

It should also be appreciated, that heretofore in the prior art with respect to rope chains, once a particular link shape and size was selected, that same link was utilized throughout the formation of the rope chain. While that link may have been of a specific geometric configuration and specific wire cross sectional, nevertheless it was utilized throughout the entire helix cycle forming the rope chain.

While it has been known to combine rope chains with other types of chain sections, as by way of example the Figarope rope chain described in DES 326,065, it should be appreciated that this chain represents a combination of rope chain sections interconnected with a different type of chain section. However, the portions defining the rope chain portion always included the same identical links throughout the formation of the rope chain.

The present invention can best be understood by reference to FIGS. 10*a*–10*f* showing the formation of a rope chain in accordance with the present invention. By way of example, in this case a rope chain having a 5:1 ratio is shown, however such is only for ease of understanding and it should be understood that any ratio can likewise be utilized.

Figure 10A:
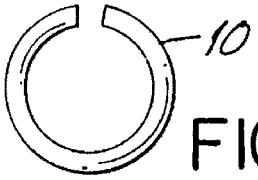
FIGS. 10*a*–10*f* show various steps in the formation of a rope chain in accordance with the present invention.
Figure 10B:
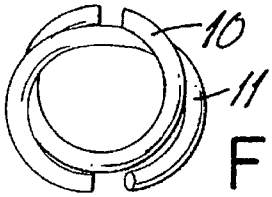
Figure 10C:
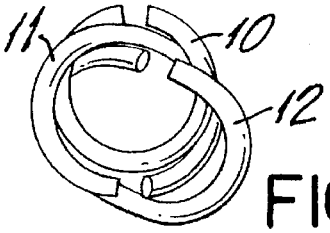

It will be noted that with reference to FIG. 10*a*, a round link is initially utilized, shown generally at 10. With reference to FIG. 10*b* when it comes to inserting the next adjacent link, instead of utilizing a round link identical to that previously utilized, a link is chosen 11 with a slightly different configuration, in this case being slightly oval. With reference to FIG. 10*c*, it is now noted that the third link 12 is different from the other two links and it has a full oval shape.

Figure 10D:
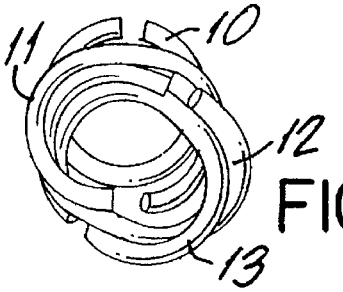
Figure 10E:
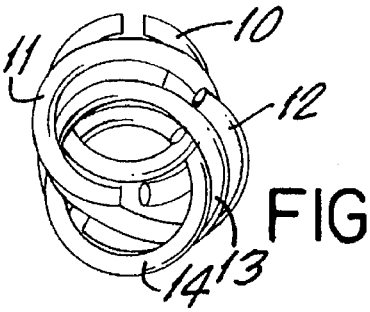
Figure 10F:
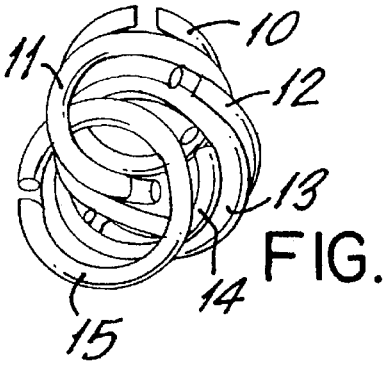

Referring to FIG. 10*d*, the next link 13, is again slightly oval and basically similar to the slightly oval link 11 utilized previously. With reference to FIG. 10*e*, again a round link is utilized as link 14. It will be noted, that basically this completes a group sequence of five intertwined links. With reference to FIG. 10*f*, the sequence is again continued and this time using again a slightly oval link 15 is utilized.

It will thus be noted that a sequence of ascending and descending type of a cyclical arrangement has been utilized. Namely, starting with a round link, moving to a slightly oval and thereafter a full oval (or ellipse). The sequence is then returned by going back to the slightly oval and returning to the round link. Thereafter, the sequence is again repeated going to the slightly oval, and then returning to an oval, slightly oval, round link, etc. This sequence is hereinafter referred to as an ascending-descending repetitive sequence.

It should be noted, that the particular sequence is not directly related to the Di:Dw ratio. Thus, the same sequence would be utilized whether it be a 3:1 ratio or a 7:1 ratio. Namely, the sequence would repeat.

It should further be appreciated, that while in this example only three links of different geometric shapes were chosen, there could be numerous other types of sequences. For example, if there were five different shapes, the sequence would be 1, 2, 3, 4, 5, 4, 3, 2, 1, 2, etc.

By selecting the desired link shapes and determining the number of links in a particular helix cycle, different types of rope chain configurations can be obtained and the total number of different types of links.

Figure 11:
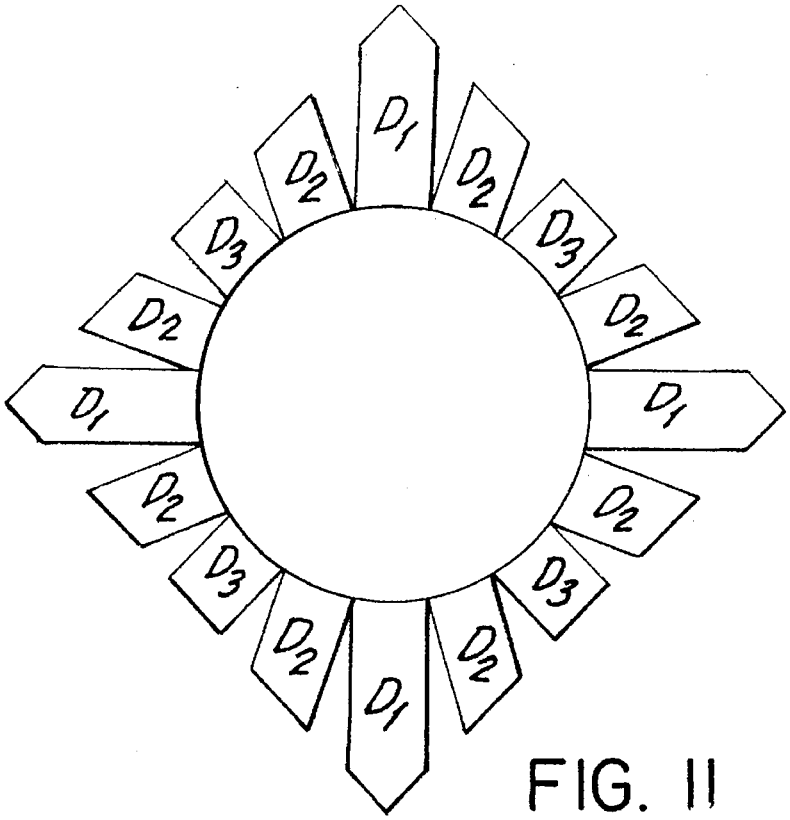
FIG. 11 shows a schematic view showing the cross sectional configuration of the rope chain in accordance with the embodiment of the present invention.

By way of example as shown in FIG. 11, there are 16 links required to complete helix cycle of the particular configuration shown. If four sides are desired as the overall configuration of the rope chain, then there are essentially four links to each side. Utilizing the ascending-descending repetitive sequence, it is shown to utilize the sequence D1, D2, D3, D2, D1, D2, etc. In this matter, the links D3 would be oval links, the links D1 would be round, and the links D2 would be slightly oval between round and oval.

It should be appreciated that in using the configuration shown in FIG. 11, because the particular links are selected having ranges between round and oval (elliptical), there results essentially in a square sided configuration. It will also be appreciated, that such square sided configuration corresponds generally to a faceted rope chain having substantially four flat sides with slightly rounded corners. Thus, by selecting the particular arrangement heretofore described, one can effectively form faceted rope chain shown in FIG. 11.

One should also appreciate that in forming a faceted rope chain of FIG. 11, one can actually form such a chain from hollow links. As there is no shaving, cutting, or even deforming of the links, by forming the chains with the sequence of links as directed, one inherently obtains the flat surface along the four sides without any cutting at all. Thus, even thin walled hollow chain can be formed into a diamond cut faceted rope chain using the techniques of the present invention.

It should be appreciated, that some surface polishing, or shining could be carried out on the flattened surfaces shown.

If instead of four sides, it is desired to make a chain having a six sided cross section, then the sixteen individual links divided by six sides give approximately two and a half links for each side. Thus, one would probably choose three links for each side to achieve the close approximation to a six sided figure. Furthermore, any other type of external configuration could likewise be achieved by specific design.

While heretofore the type of chain shown in FIG. 11 has been described by initially forming the chain with different geometrically shaped links, another method of producing this result can also be utilized. In an alternate method, initially a standard type of rope chain can be formed as in the prior art utilizing all of the links having the same geometric configuration. The entire chain is then passed through a series of rollers which reshape some of the links. Thus, by way of example, and with reference to FIG. 12, a chain of uniform circular links would give a chain cross section having the configuration as shown. By passing the entire finished chain through a series of orthogonal rollers, some of the individual links would be reshaped into the configuration shown in FIG. 11.

Figure 13:
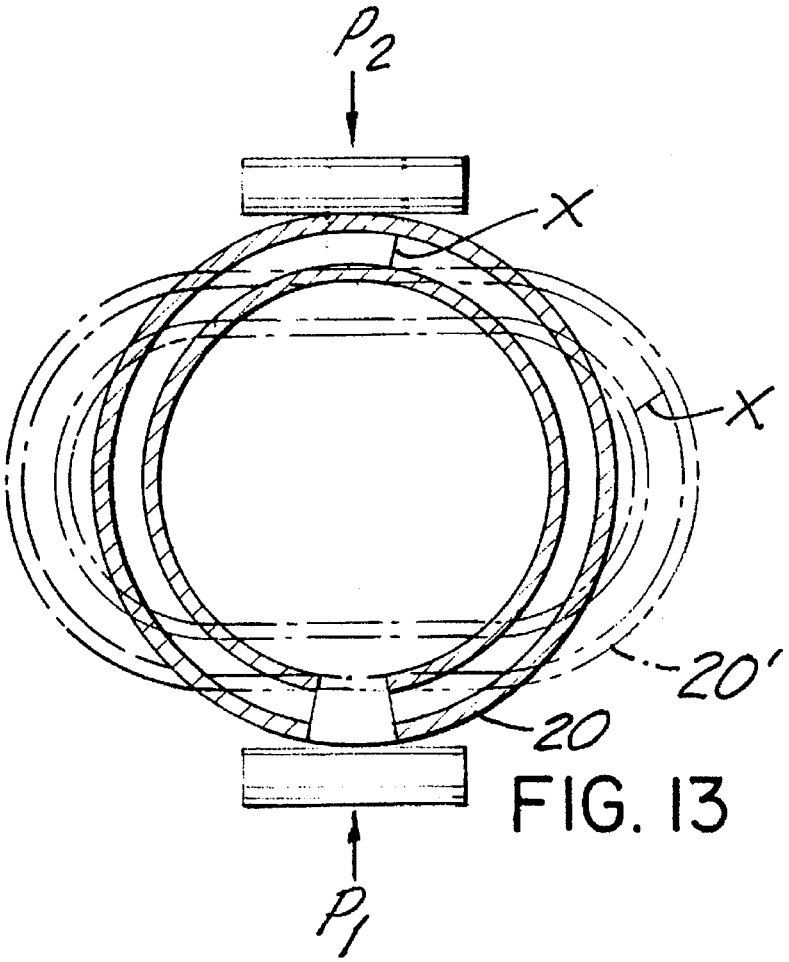
FIG. 13 shows the changing of the configuration of a link in accordance with the present invention.

By way of example, applying the rollers at points P1 and P2 in FIG. 13 would exert pressure on the initially circular link 20 and reshape it into an oval link shown at 20' in dotted lines. In this case, we are dealing with a hollow link and the entire configuration of the link has been changed from circular to oval. It is noted, however, that the cross sectional diameter X of the link hollow wire is not deformed but remains constant both in the circular configuration as well in the oval configuration. There is no deformation at all of the cross section of the wire but only a reshaping of the geometric configuration of the link.

Figure 14:
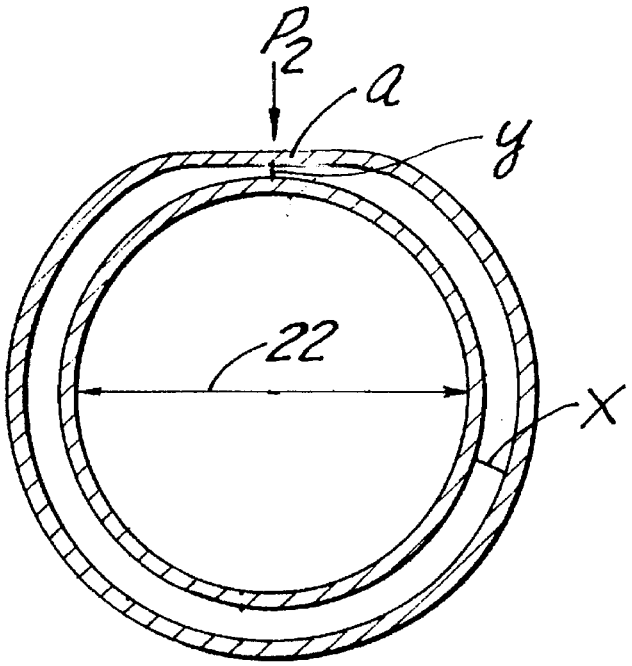
FIG. 14 shows a schematic showing the prior art use of deformation of the walls of a hollow link.
Figure 15A:
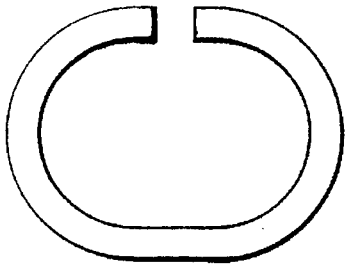
FIGS. 15*a*–15*f* show various overall configurations of geometric shapes of links.
Figure 15D:
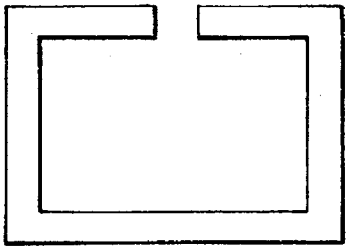
Figure 15B:
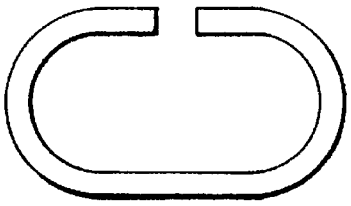
Figure 15E:
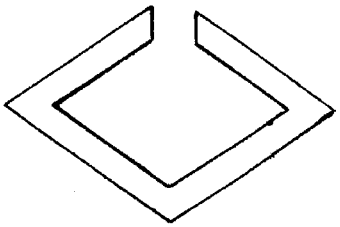
Figure 15C:
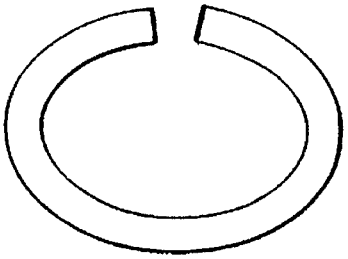
Figure 15F:
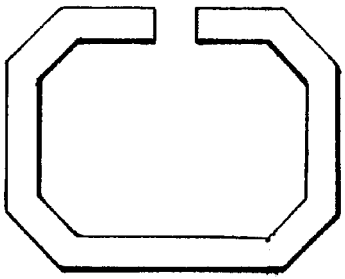
Figure 16A:
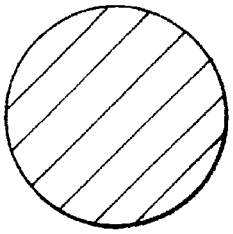
FIGS. 16*a*–16*e* show various cross sectional configurations of wires that can be utilized to form the links.
Figure 16B:
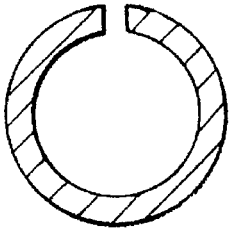
Figure 16C:
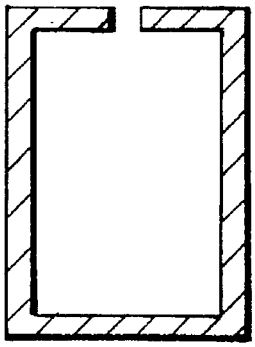
Figure 16D:
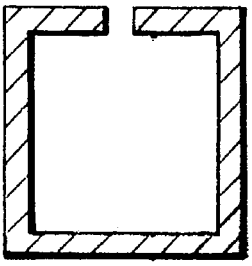
Figure 16E:
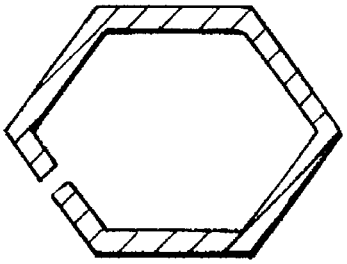
Figure 17:
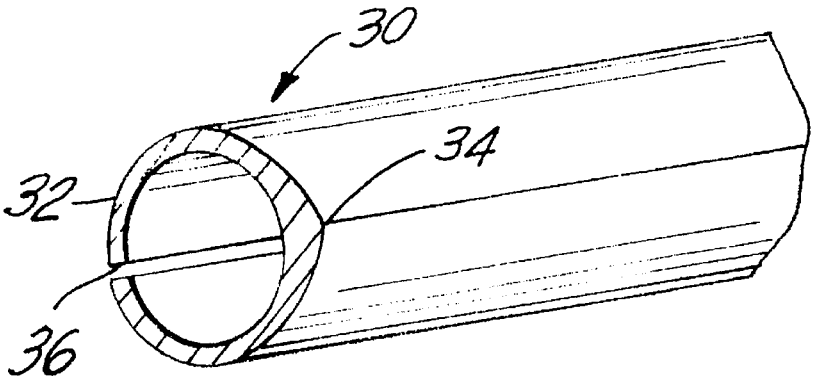
FIG. 17 is a perspective view of a hollow wire showing a reinforced outer peripheral section.

By way of comparison, reference is made to FIG. 14 wherein there is shown a link of the type described in the Strobel U.S. Pat. Nos. 5,125,225 and 5,129,220. In that case, in order to provide a simulated faceted appearance, pressure is applied by pounding at the point shown at P2 along the outer wall of the link. The overall configuration of the link as determined by its inner diameter 22, remains circular. However, the wire having a general diameter X now has a reduced diameter Y at the point of pounding whereby the outer wall of the wire a is deformed and pressed down closer to the inner wall b. The configuration of the link itself however remains unaffected. This is different from the present invention where just the opposite occurs, namely the overall geometric configuration of the link is changed but the cross section of the link wire remains the same throughout.

Although heretofore the particular embodiment described related to the use of a sequence of a geometric shape between a circle and an oval, it should be appreciated that any other sequence of geometric shapes can be utilized. By way of example, there is shown in FIGS. 15*a* to 15*f* different geometric configurations of the overall link which can be utilized. Here again, however it should also be appreciated that this merely by way of example and any other type of geometric configuration of the link could also be utilized.

Furthermore, the cross sectional shape of the wire can also be of any configuration whether it be solid or hollow. By way of example, FIGS. 16*a*–16*e* show various cross sectional wire configurations that can be used, whether solid or hollow, for the particular wire.

Figure 12:
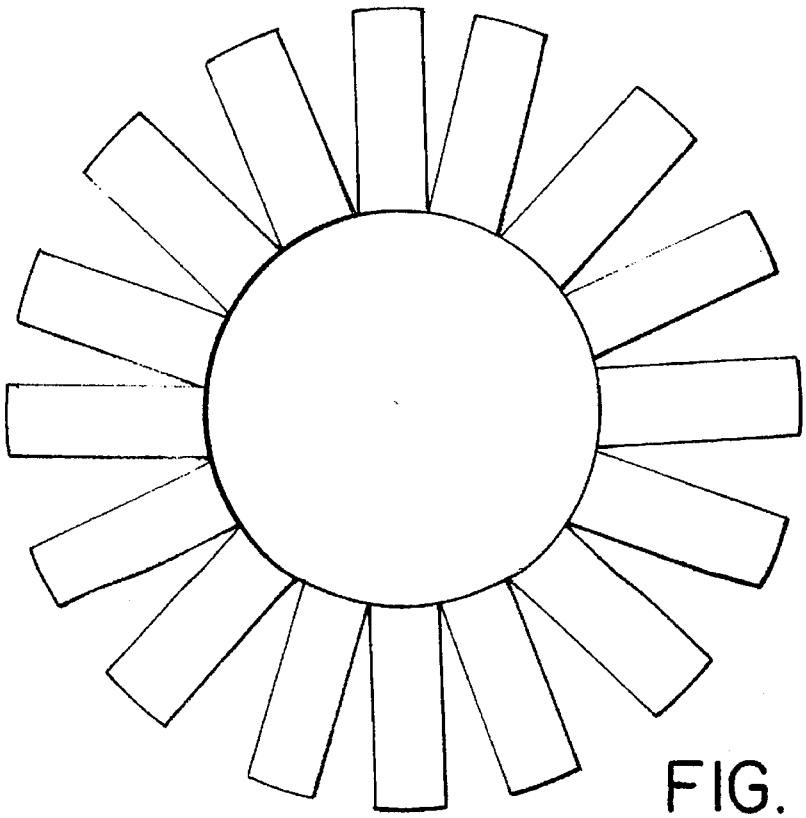
FIG. 12 shows a schematic similar to that shown in FIG. 11 for a prior art rope chain.

In order to sustain the pressure executed by the rollers when changing of the shape of the link, a hollow wire link can be used having a reinforced exterior adjacent the peripheral location of the roller. As shown in FIG. 12, the internal cross section of the wire is that of a circle, shown generally at 30. In this case, the walls 32 are generally of uniform thickness with the exception that on the outer peripheral edge 34 it is thicker. A seam 36 is provided, as usual. In this case, the thicker section 34 will be such as to prevent the roller pressure from distorting the link wire cross section while allowing changing the overall geometry.

It should be understood that the foregoing disclosure relates to only a preferred embodiment of the invention and that it is intended to cover all changes and modifications of the examples of the invention herein chosen for the purpose of the disclosure, which modifications do not constitute departures from the spirit and scope of the invention.

What is claimed is:

1. A jewelry rope chain comprising:

a plurality of links, each of said links formed of a wire of a respective cross sectional configuration, said links being intertwined to form a plurality of full helix cycles and provide an outward appearance of a double helix, a predetermined number of said links being required to form a full helix cycle, and wherein the overall geometric shapes of multiple adjacent links within each half of said full helix cycle are different from one another.

2. A jewelry rope chain as in claim 1, wherein the overall geometric shape of the individual links forming a full helix cycle of the chain sequentially define repetitive sequences of geometric shapes.

3. A jewelry rope chain as in claim 2, wherein a sequence of geometric shapes forms a repetitive sequence in one of an ascending order and a descending order.

4. A jewelry rope chain as in claim 3, wherein said sequence of geometric shapes gradually proceeds in from a round overall configuration to an elliptical overall configuration and back to a round overall configuration.

5. A jewelry rope chain as in claim 4, wherein said sequence of geometric shapes repeats approximately four times within a full helix cycle.

6. A jewelry rope chain as in claim 4, wherein said sequence of geometric shapes repeats a fixed number of times within a full helix cycle to provide a desired overall configuration to the rope chain.

7. A jewelry rope chain as in claim 4, wherein the exterior of the rope chain in the vicinity of the elliptical configured links simulates a facet.

8. A jewelry rope chain as in claim 1, wherein the geometric shapes of links are selected from the group consisting of squares, rectangles, circles, ovals, rhombus, ellipses, hexagons and triangles.

9. A jewelry rope chain as in claim 1, wherein the links are formed of solid wire.

10. A jewelry rope chain as in claim 1, wherein the links are formed of hollow wire.

11. A jewelry rope chain as in claim 1, wherein the wire cross sectional configuration of all the links are substantially identical.

12. A jewelry rope chain as in claim 10, wherein the hollow wire comprises an increased thick peripheral wall section, and wherein the cross section of the hollow wire forming a link is substantially uniform throughout the link.

13. A jewelry rope chain as in claim 1, wherein the wire cross sectional configuration of each link is substantially uniform throughout that link.

14. A jewelry rope chain as in claim 1, wherein each link has a small gap to enable one of said links to pass through the gap of another link.

15. A jewelry rope chain as in claim 7, wherein the link wire cross sectional configuration is selected from the group consisting of squares, rectangles, circles, ovals, rhombus, ellipses, hexagons, triangles.

16. A jewelry rope chain as in claim 10, and comprising a seam along the interior periphery of the link.

17. A jewelry rope chain as in claim 12, wherein at least some of the links comprise an increased thick wall section along an external periphery thereof.

18. A method of manufacturing a jewelry rope chain comprising;

a) intertwining a plurality of substantially identical links into a double helix configuration, each link having substantially the same overall geometric shape, each link having a substantially identical cross sectional configuration, and b) reshaping the outer configuration of the rope chain by changing the shape of at least some of the links to a different overall geometric shape than the others without substantially changing the cross sectional configuration of the reshaped links.

19. The method as in claim 18, wherein said step of reshaping comprises the step of passing the rope chain through a series of rollers.

20. The method as in claim 19, wherein said reshaping changes the overall geometric shape of some of the links from a round shape to an oval shape.

21. A method as in claim 18, wherein each link has a small gap to enable one link to pass through the gap of another link.

22. A method of manufacturing a jewelry rope chain comprising the steps of intertwining a plurality of links to form a plurality of full helix cycles and provide a double helix configuration, there being a predetermined number of links required to form a full helix cycle, and where in the overall geometric shapes of multiple adjacent links within each half of said full helix cycle are different from one another, and soldering selected ones of the links to retain a chain shaped as a rope chain.

* * * * *